US007975336B1

(12) United States Patent
Perry et al.

(10) Patent No.: US 7,975,336 B1
(45) Date of Patent: Jul. 12, 2011

(54) PILLOW FOR SLEEPING ON ONES BACK OR UPRIGHT

(76) Inventors: Mary N. Perry, Port Washington, NY (US); Nancy Sinoway, Port Washington, NY (US)

( * ) Notice: Subject to any disclaimer, the term of this patent is extended or adjusted under 35 U.S.C. 154(b) by 0 days.

(21) Appl. No.: 12/964,903

(22) Filed: Dec. 10, 2010

(51) Int. Cl.
*A47G 9/10* (2006.01)

(52) U.S. Cl. ..... 5/640; 5/636

(58) Field of Classification Search ..... 5/640, 636, 5/637, 645, 657
See application file for complete search history.

(56) References Cited

U.S. PATENT DOCUMENTS

| | | | | | |
|---|---|---|---|---|---|
| 1,385,355 | A * | 7/1921 | Banks | 5/636 |
| 2,167,622 | A * | 8/1939 | Bentivoglio | 5/636 |
| 2,562,725 | A * | 7/1951 | Leto et al. | 5/631 |
| 2,700,779 | A * | 2/1955 | Tolkowsky | 5/632 |
| 2,877,472 | A * | 3/1959 | Wagner | 5/636 |
| 3,849,810 | A * | 11/1974 | Degen | 5/640 |
| 4,031,578 | A * | 6/1977 | Sweeney et al. | 5/426 |
| 5,182,828 | A * | 2/1993 | Alivizatos | 5/631 |
| 5,214,814 | A * | 6/1993 | Eremita et al. | 5/636 |
| 5,457,832 | A * | 10/1995 | Tatum | 5/636 |
| 5,467,782 | A * | 11/1995 | Wiseman | 5/636 |
| 6,006,381 | A * | 12/1999 | Tandrup | 5/655 |
| 6,073,288 | A * | 6/2000 | Berenstein | 5/636 |
| 7,120,953 | B2 * | 10/2006 | Ferber et al. | 5/636 |
| 2006/0123547 | A1 * | 6/2006 | Ferber et al. | 5/636 |

FOREIGN PATENT DOCUMENTS

GB 2030448 A * 4/1980

* cited by examiner

*Primary Examiner* — Robert G Santos
(74) *Attorney, Agent, or Firm* — Antonio Papageorgiou; Ostrow Kaufman LLP

(57) ABSTRACT

A pillow is provided that includes a center section; a first bolster; and a second bolster. The first bolster is attached to the center section on a first lateral side and the second bolster is attached to the center section on a second lateral side opposite the first lateral side, and at least one of the first and the second bolsters has a first cross sectional area at a bottom of the bolster and a second cross sectional area at a top of the bolster greater than the first cross sectional area.

13 Claims, 5 Drawing Sheets

PILLOW FOR SLEEPING ON ONES BACK OR UPRIGHT

BACKGROUND OF THE INVENTION

The present application relates to pillows and more particularly pillows for sleeping on ones back or in an upright position.

A number of pillows are on the market, including many travel pillows for use in sleeping in an upright position. The most popular appears to be the horse-shoe shaped pillow that fits around the wearer's neck. These pillows, however, have numerous drawbacks. For instance, the horse-shoe shaped pillow does not provide any support on the side of a user's head, which allows the user's head to tilt and rotate sideway in a rather uncomfortable position.

Accordingly, there is a need for a pillow that is not so limited.

SUMMARY OF THE INVENTION

A pillow is provided that includes a center section; a first bolster; and a second bolster. The first bolster is attached to the center section on a first lateral side and the second bolster is attached to the center section on a second lateral side opposite the first lateral side, and at least one of the first and the second bolsters has a first cross sectional area at a bottom of the bolster and a second cross sectional area at a top of the bolster greater than the first cross sectional area.

In at least one embodiment, the center section is flat with an essentially continuous thickness.

In at least one embodiment, the center section has a top having a first length and a bottom having a second length greater than the first length.

In at least one embodiment, the center section has a generally trapezoidal shape.

In at least one embodiment, at least one of the first and the second bolsters are hinged to the center section at an intersection thereof.

In at least one embodiment, a cross section of at least one of the first and the second bolsters increases from the bottom to the top of the at least one of the first and the second bolsters.

In at least one embodiment, at least one of the first and the second bolsters has a triangular cross section at the top of the at least one of the first and the second bolsters.

In at least one embodiment, at least one of the first and the second bolsters has a triangular cross section at the bottom of the at least one of the first and the second bolsters.

In at least one embodiment, a cross section of at least one of the first and the second bolsters remains constant, decreases, or increases from the bottom of the at least one of the first and the second bolsters to a point between the bottom and the top of the at least one of the first and the second bolsters, and increases from the point between bottom and the top of the at least one of the first and the second bolsters to the top of the at least one of the first and the second bolsters.

In at least one embodiment, a cross section of at least one of the first and the second bolsters increases from the bottom of the at least one of the first and the second bolsters to a point between the bottom and the top of the at least one of the first and the second bolsters at a first rate, and increases from the point between bottom and the top of the at least one of the first and the second bolsters to the top of the at least one of the first and the second bolsters at a second rate.

In at least one embodiment, a pillow is provided that includes a flat, generally trapezoidal center section with an essentially continuous thickness, the center section having a top with a first length and a bottom with a second length greater than the first length; a first bolster; and a second bolster. The first bolster is hinged to the center section on a first lateral side and the second bolster is hinged to the center section on a second lateral side opposite the first lateral side, and at least one of the first and the second bolsters has a first triangular cross sectional area at a bottom of the at least one of the bolster and a second triangular cross sectional area at a top of the bolster greater than the first cross sectional area, and a cross section of at least one of the first and the second bolsters increases from the bottom of the at least one of the first and the second bolsters to a point between the bottom and the top of the at least one of the first and the second bolsters at a first rate, and increases from the point between bottom and the top of the at least one of the first and the second bolsters to the top of the at least one of the first and the second bolsters at a second rate.

Additional aspects of the present invention will be apparent in view of the description which follows.

DETAILED DESCRIPTION OF THE INVENTION

A pillow is provided herewith for use by an individual that sleeps or wants to sleep on his or her back, or that wants to sleep in an upright position, such when traveling. It is understood that the pillow may be made from a variety of materials and techniques. For example, the pillow may be a foam pillow preformed or a filled pillow sewn into the desired shape as discussed herein. The fabric for the filled pillow may be made from any natural and/or synthetic material, such as cotton, cotton blends, polyester, spandex, silk, etc. The filling too may be any type of material, such as down, cotton, polyester fill, micro beads, chopped foam, etc.

Figure 1:
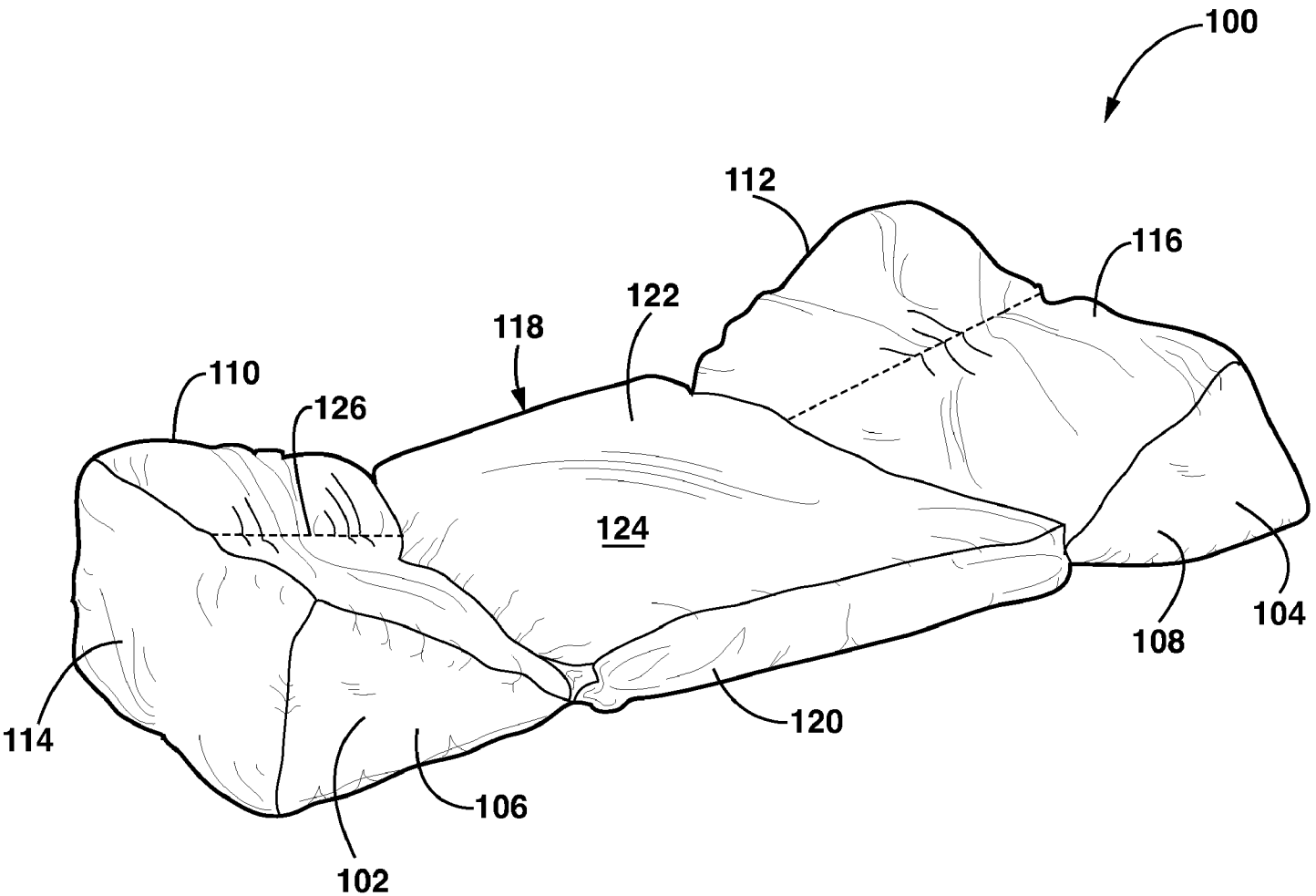
FIG. 1 is a perspective view of a pillow according to at least one embodiment of the pillows disclosed herein.

Referring to FIG. 1, a pillow according to one embodiment of the pillows disclosed herein includes a center section 122 with a first bolster 102 and a second bolster 104 on opposite lateral sides of the center section 122. The center section 122 is relatively flat and has an essentially continuous thickness. In order to accommodate the shape of the bolsters 102, 104, the center section 122 has a top 118 having a first length and a bottom 120 having a second length greater than the first length. The center section 122 therefore has a generally trapezoidal shape as viewed from the top. In use, the back of an individual's head rests on the upper surface 124 of the center section 122 with the top of the head toward the top 118 and the neck toward the bottom 120.

The left bolster 102 and the right bolster 104 are formed or otherwise attached to the center section 122. The intersection of the bolsters 102, 104 and the center section 122 preferably act as a hinge that allows the pillow to be folded in three. The left bolster 102 and the right bolster generally have a cross section with an area that increases from the bottom 106 to the top 110 of the bolster 102. This variability in the cross section of the bolsters 102, 104 provides greater material and thus support at the top of the pillow 100. In use, the additional material acts on the upper sides of the user's head to prevent the user's head from tilting and rotating sideways. The wider opening at the user's face and neck provides an open, less constricting feeling.

The pillow of the present application serves numerous purposes. For example, as a beauty aid, the pillow prevents or lessens sleep lines on the face. This is accomplished by promoting sleeping on one's back and maintaining the user's head in an upward facing direction. The pillow also provides added comfort in various situations, especially for sleeping on one's back, while watching TV upright on a recliner or a high back chair/couch. A traditional pillow may also be used under the pillow of the present application to raise the user's head further upright. For back sleepers and DSAEK (a new technique that is used for cornea transplants) patients that have to sleep on their backs for about one week after surgery, the pillow maintains the stability of the head while the user is lying on his or her back. Pregnant women often experience difficulty sleeping on their backs once their pregnancies progress as a result of the increased pressure from the growing fetus (baby) on the mother's lungs making it uncomfortable for the mother to sleep on her back and difficult for her to breath. Some women even have to sleep in a sitting position in a bed or on a chair for relief. The pillow of the present application helps provide the expecting mother a more comfortable sleep in these situations. As the pillow of the present application provides unique support to the user in upright positions, the pillow or a smaller version thereof should work nicely for travel by to comfortably support the head and preventing the head from rolling to the side.

Figure 2:
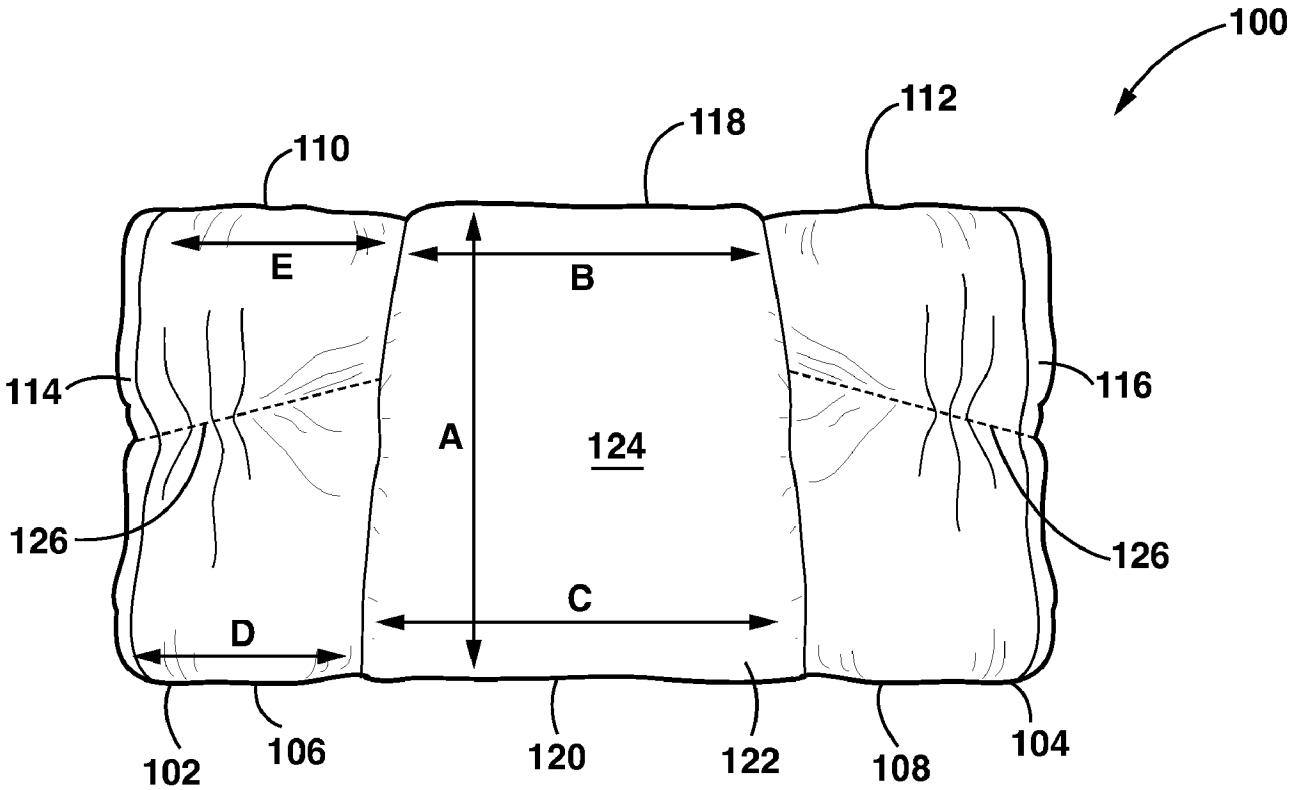
FIG. 2 is a top view of a pillow according to at least one embodiment of the pillows disclosed herein.

It is understood that the variable cross section area as discussed above maybe achieved in a variety of ways. In one embodiment, the bolsters 102, 104 have a triangular shape with a first cross sectional area at the bottom 106, 108 of the bolsters 102, 104 and a second cross sectional area at the top 110, 112, of the bolsters 102, 104. In this instance, the cross sectional area of the top triangles 110, 112 are greater than the cross sectional areas of the bottom triangles 106, 108. The cross sectional area from the bottom 106, 108 to the top triangles 110, 112, may increase linearly, nonlinearly, exponentially, etc., or a combination thereof. For example, the cross sectional area may remain essentially constant, decrease, or increase at a first rate from the bottom 106 to a point 126 midway between the top 110 and the bottom 106. At the point 126, the cross sectional area may then increase up to the top 110 at a second rate, linearly or otherwise. The transition at point 126 may be created in a filled pillow by pleating the fabric of the bolsters at the transition point as shown in FIG. 2. The bolsters 102, 104, are preferably symmetrical about a central axis that extends from the top to the bottom of the pillow 100.

Referring to FIG. 2, as can be seen the center section 122 has a trapezoidal shape with dimensions A, B, and C. In one embodiment, A is about 11.5 inches, B is about 9 inches, and C is about 10.5 inches. The dimension E at the top of the bolster may be about 6.5 inches and D at the bottom of the bolster may be 4.5 inches. The dimensions given herein may be varied about 10% to about 20% for specific applications, such as for smaller travel pillows. Moreover, with filled pillows, the dimensions of the fabric sections that make up the pillow are nominal. Once assembled, the pillow will have approximate dimensions dictated by the dimensions of the fabric and the amount of the stuffing as well as the manner in which the fabrics are sewn, e.g., with tufting, gathering, gusseting, etc.

Figure 3:
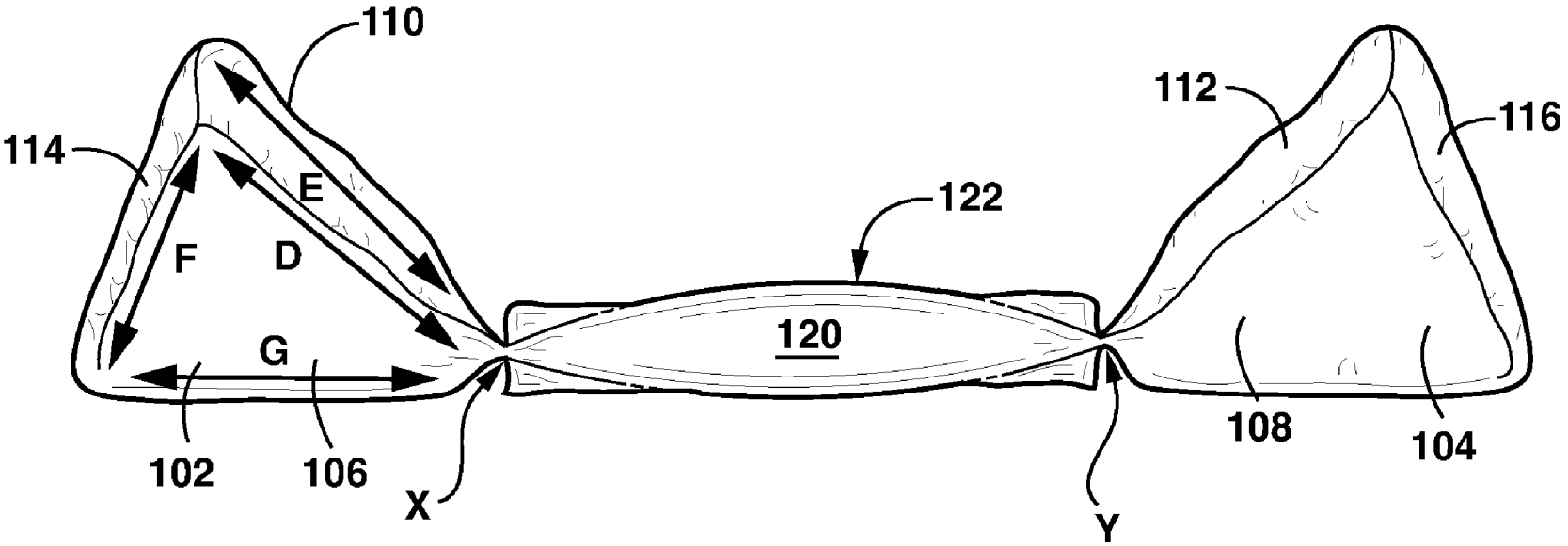
FIG. 3 is a front view of a pillow according to at least one embodiment of the pillows disclosed herein.
Figure 4:
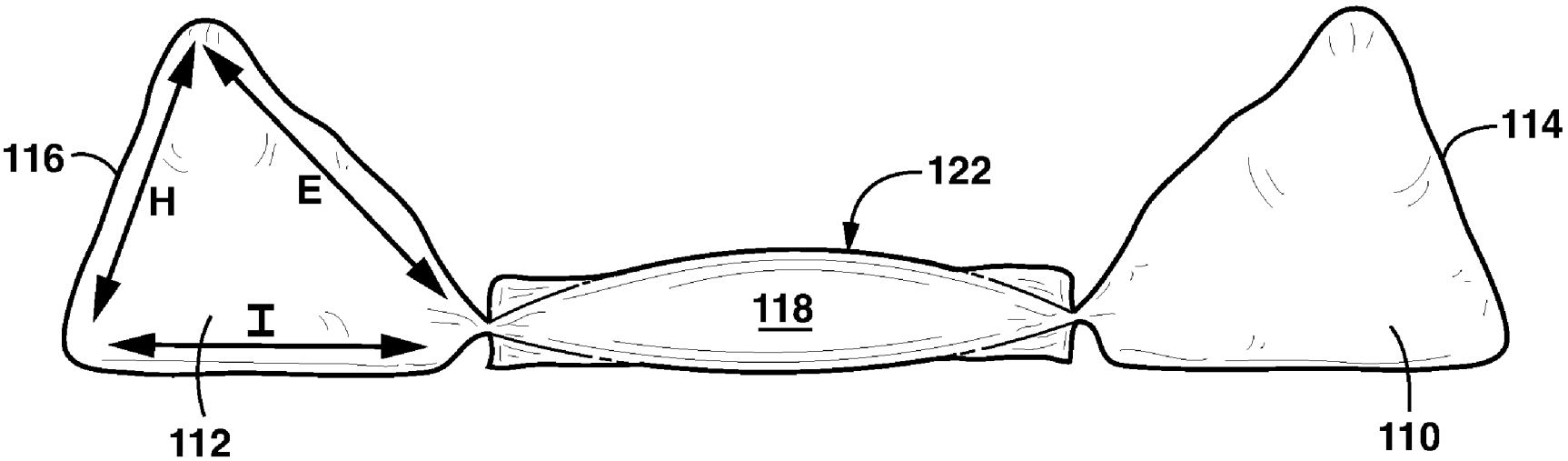
FIG. 4 is a back view of a pillow according to at least one embodiment of the pillows disclosed herein.
Figure 5:
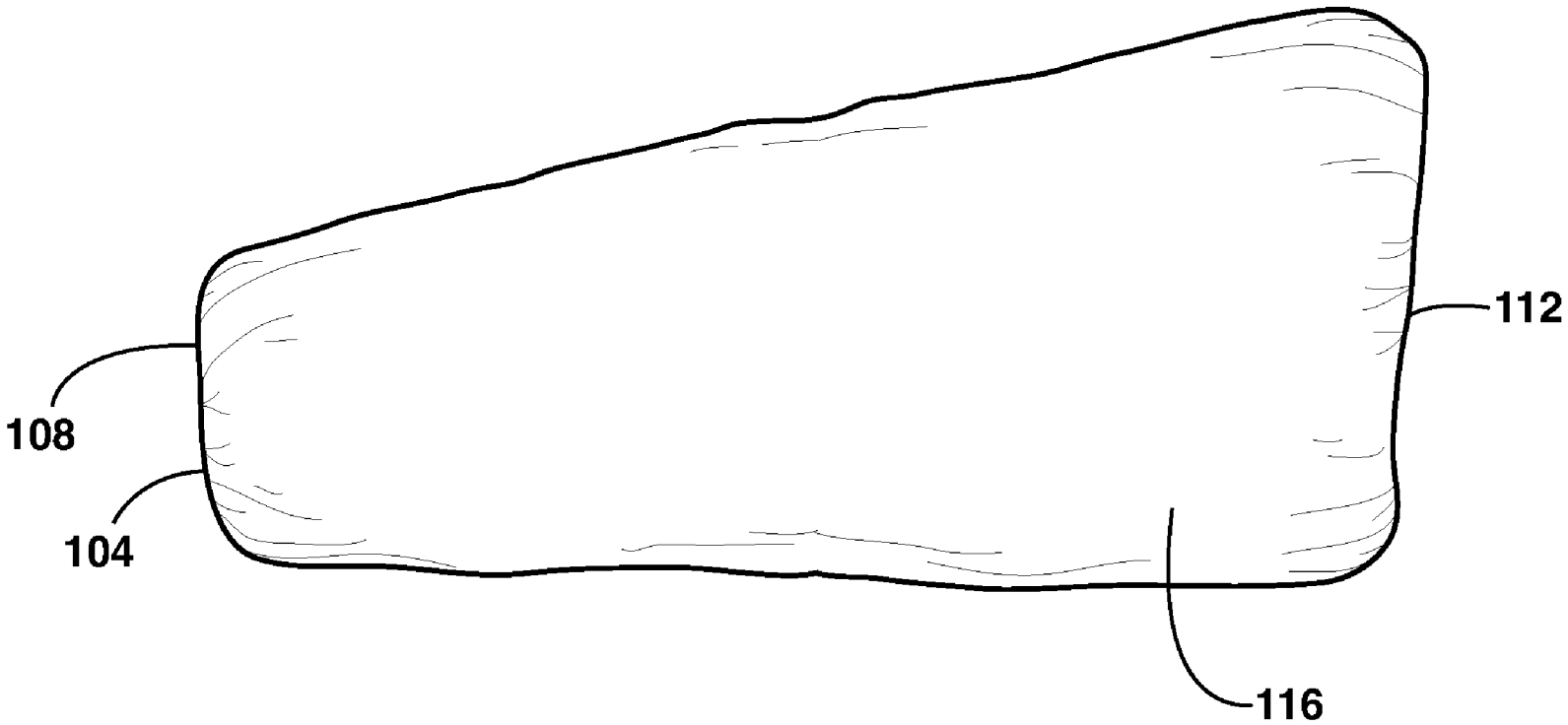
FIG. 5 is a side view of a pillow according to at least one embodiment of the pillows disclosed herein.

Referring to FIG. 3, the triangle at the bottom 106 of the bolster 102 may have dimensions D, F, and G of about 4.5 inches, 4 inches, and 4.5 inches, respectively. The center section 122 may be pleated at points X and Y as shown to better allow the pillow to fold at these points. Referring to FIG. 4, the triangle at the top 112 of the bolster 104 may have dimensions E, H, and I of about 6.5 inches, 6 inches, and 6.5 inches, respectively.

Although the pillow has been described herein with certain shapes, e.g., trapezoids, triangles, etc., it is understood that various other shapes may be used in the pillow. For example, instead of triangles, rectangles, trapezoids, ovals, circles etc. may be incorporated into the top and/or the bottom of the bolsters. Additionally, the shape of the top does not necessarily have to be the same as the shape of the bottom. For example, the bottom may be circular and the top may be a triangle. In this instance, at the point 126 the bolster will transition from a cylinder to a wedge.

While the foregoing invention has been described in some detail for purposes of clarity and understanding, it will be appreciated by one skilled in the art, from a reading of the disclosure that various changes in form and detail can be made without departing from the true scope of the invention.

What is claimed is:

1. A pillow with opposing lateral ends and opposing top and bottom ends therewith forming a generally rectangular shape, such that when used, the top end of the pillow is located near a top of a user's head and the bottom end of the pillow is near the users' neck, the pillow comprising:

a center section;

a first bolster that extends from the top end to the bottom end of the pillow; and a second bolster that extends from the top end to the bottom end of the generally rectangular pillow, wherein the first bolster is attached to the center section on a first lateral side of the center section and the second bolster is attached to the center section on a second lateral side opposite the first lateral side of the center section, and wherein at least one of the first and the second bolsters has a first cross sectional area at a bottom of the bolster and a second cross sectional area at a top of the bolster greater than the first cross sectional area, and wherein a cross section of the at least one of the first and the second bolsters increases continually from the bottom end of the pillow to the top end of the pillow, and wherein the cross sectional area of the at least one of the first and the second bolsters increases continually from the bottom end of the pillow to a point between the bottom and the top ends of the pillow at a first rate, and increases continually from the point between the bottom and the top ends of the pillow to the top end of the pillow at a second rate greater than the first rate, the center section therewith having a generally trapezoidal shape tapering toward the top of the pillow at a rate that increases at the point between the bottom and the top ends of the pillow.

2. The pillow of claim 1, wherein the center section extends from the top end to the bottom end of the pillow and is flat with an essentially continuous thickness between the top and the bottom ends of the pillow.

3. The pillow of claim 1, wherein the center section has a top at the top end of the pillow having a first length and a bottom at the bottom end of the pillow having a second length greater than the first length.

4. The pillow of claim 1, wherein at least one of the first and the second bolsters are hinged to the center section at an intersection thereof.

5. The pillow of claim 1, wherein the cross sectional areas of at least a portion of the at least one of the first and the second bolsters increase linearly from the bottom end to the top end of the pillow.

6. The pillow of claim 5, wherein at least one of the first and the second bolsters has a triangular cross section at the top of the pillow.

7. The pillow of claim 6, wherein at least one of the first and the second bolsters has a triangular cross section at the bottom of the pillow.

8. The pillow of claim 5, wherein the cross section of the at least one of the first and the second bolsters increases continually from the bottom end of the pillow to a point between the bottom and the top ends of the pillow at a first rate, and increases continually from the point between the bottom and the top ends of the pillow to the top end of the pillow at a second rate.

9. A pillow with opposing lateral ends and opposing top and bottom ends therewith forming a generally rectangular shape, such that when used, the top end of the pillow is located near a top of a user's head and the bottom end of the pillow is near the users' neck, the pillow comprising:

a flat, generally trapezoidal center section that extends from the top end to the bottom end of the pillow and with an essentially continuous thickness, the center section having a top at the top end of the pillow with a first length and a bottom at the bottom end of the pillow with a second length greater than the first length;

a first bolster that extends from the top end to the bottom end of the pillow; and a second bolster that extends from the top end of the bottom end of the generally rectangular pillow, wherein the first bolster is hinged to the center section on a first lateral side and the second bolster is hinged to the center section on a second lateral side opposite the first lateral side of the center section, and wherein at the first and the second bolsters have a first triangular cross sectional area at the bottom end of the pillow and a second triangular cross sectional area at the top end of the pillow greater than the first cross sectional area, and wherein a cross section of the first and the second bolsters increases continually from the bottom end of the pillow to the top end of the pillow, and wherein the cross sectional area of the first and the second bolsters increases continually from the bottom end of the pillow to a point between the bottom and the top ends of the pillow at a first rate, and increases continually from the point between the bottom and the top ends of the pillow to the top end of the pillow at a second rate greater than the first rate, the center section therewith having a generally trapezoidal shape tapering toward the top of the pillow at a rate that increases at the point between the bottom and the top ends of the pillow.

10. The pillow of claim 9, wherein at least one of the cross sectional areas of the bolsters increase linearly.

11. The pillow of claim 9, wherein at least one of the cross sectional areas of the bolsters increase exponentially.

12. The pillow of claim 9, wherein the cross sectional area of the bolsters increase exponentially from the point between the bottom and top ends of the pillow to the top end of the pillow.

13. The pillow of claim 9, wherein the bolsters are hinged such that the pillow may be used on either side.

* * * * *